US008529228B1

(12) United States Patent
Thompson

(10) Patent No.: US 8,529,228 B1
(45) Date of Patent: Sep. 10, 2013

(54) SUMP PUMP COVER

(76) Inventor: Tim Thompson, Brainerd, MN (US)

( * ) Notice: Subject to any disclaimer, the term of this patent is extended or adjusted under 35 U.S.C. 154(b) by 492 days.

(21) Appl. No.: 12/824,643

(22) Filed: Jun. 28, 2010

Related U.S. Application Data

(60) Provisional application No. 61/221,633, filed on Jun. 30, 2009.

(51) Int. Cl.
*F04B 49/04* (2006.01)

(52) U.S. Cl.
USPC ..... 417/423.3; 417/40

(58) Field of Classification Search
USPC ..... 417/40, 423.3, 572
See application file for complete search history.

(56) References Cited

U.S. PATENT DOCUMENTS

| | | | | |
|---|---|---|---|---|
| 2,662,206 | A | | 12/1953 | Schaefer |
| 3,699,730 | A | | 10/1972 | Humphrey |
| 3,726,606 | A | * | 4/1973 | Peters ..... 417/7 |
| 4,080,984 | A | | 3/1978 | Klein |
| 4,087,204 | A | * | 5/1978 | Niedermeyer ..... 417/2 |
| 4,456,432 | A | | 6/1984 | Mannino |
| 4,886,426 | A | * | 12/1989 | Surinak ..... 417/360 |
| 4,890,425 | A | | 1/1990 | Mamula |
| 5,449,274 | A | * | 9/1995 | Kochan, Jr. ..... 417/8 |
| D385,944 | S | | 11/1997 | Hatfield |
| 5,924,846 | A | * | 7/1999 | Arnold et al. ..... 417/36 |
| 6,276,093 | B1 | | 8/2001 | Janesky |
| 7,264,449 | B1 | | 9/2007 | Harned |
| 2004/0231247 | A1 | | 11/2004 | Thachenkery |

FOREIGN PATENT DOCUMENTS

| | | |
|---|---|---|
| CA | 945417 | 4/1974 |

* cited by examiner

*Primary Examiner* — Peter J Bertheaud
(74) *Attorney, Agent, or Firm* — Patent Law Offices of Rick Martin, P.C.

(57) ABSTRACT

A plastic hood is connected above a sump pump via the discharge pipe. A clamp on the hood secures a tether for the float switch. The hood prevents a tangling of the float switch between the sump pump and the discharge pipe.

11 Claims, 2 Drawing Sheets

SUMP PUMP COVER

CROSS REFERENCE APPLICATIONS

This application is a non-provisional application claiming the benefits of provisional application No. 61/221,633 filed Jun. 30, 2009.

FIELD OF INVENTION

The present invention relates to protecting the float switch of a submersible pump from getting tangled with the pump or the vertical discharge pipe.

BACKGROUND OF THE INVENTION

Liquid disposal systems are generally used for the evacuation of drainage liquids, usually non-potable wastewater, in a large number of applications. Examples of such applications are found in residence and business building sites that are subject to drainage liquid collection, such as where shallow underground water levels cause wall seepage or where ground water runoff accumulates. Whatever the source of liquid collection, liquid disposal systems find application to pump the collected liquid, which is often non-potable water, to acceptable drainage lines, usually return sewer lines or storm water drainage systems.

Over the past several years, the overall design of pump assemblies for liquid disposal applications has experienced little change. Typically, liquid disposal assemblies can utilize upright, pedestal or fully submersible pumps. Operational pump control has relied upon some form of switch arrangement to detect the presence and level of liquid collected, such as, for example, the level of wastewater in a collection basin. Such switch arrangements have included float rod and ball switches for pedestal pumps; mercury float switches; mechanical float switches; and diaphragm pressure switches. These switch designs have changed little over the past several years and continue to incur well known deficiencies.

Float switch designs are prone to failure due to such factors as wear of mechanical parts; wedging debris entanglement that prevents effective operation; and operational disconnect or maladjustment. With each of these one can expel failure of the pump to maintain a desired liquid level in a collection vessel.

Diaphragm pressure switches rely on the differential movement of a diaphragm having one side exposed to atmospheric pressure and a head pressure on the other side. It is known that such switches can vary in reliability depending on the elevation of the installation, and the breather tubes commonly used to sense atmospheric pressure are often subject to obstruction.

Submersible pumps used in liquid disposal systems are susceptible to failure when the pumping elements become clogged or otherwise frozen. Wastewater reservoirs usually contain debris that is drawn into the pump, and poor pump performance and pump damage follows.

There is a continuing need for a protective hood to cover the submerged pump and prevent the float switch from tangling with the discharge pipe and prevent debris from tangling with the float switch. The present invention answers these needs with a plastic hood that clamps to the vertical discharge pipe and supports the tether for the standard float switch. Below follows a brief description of the known related art.

U.S. Pat. No. 2,662,206 (1953) to Schaefer discloses a submersible electric motor sump pump. The pump enclosure includes a buoyant member, thus when water surrounds the pump, the buoyant member floats and turns on the pump.

U.S. Pat. No. 3,699,730 (1972) to Humphrey and French 945417 discloses a flexible plastic cover going over a sump hole, wherein the motor is not submersible but mounted above the cover.

U.S. Pat. No. 4,080,984 (1978) to Klein discloses a cylindrical sump cover that fits in the sump hole, covers the pump and has a top with a hole for the conduit output line.

U.S. Pat. No. 4,456,432 (1984) to Mannino discloses a wire tie on a sump pump discharge pipe, the wire tie holds a float switch to power a battery backup sump pump.

U.S. Pat. No. 4,890,425 (1990) to Mamula discloses a circular cover for a sump hole.

U.S. Pat. No. 7,264,449 (2007) to Harned et al. discloses a sump pump with its submersible container having a built in electronic level sensor. The container has a transparent lid.

Design Pat. No. 385,944 discloses a septic tank cover.

Pub. No. U.S. 2004/0231247 discloses a two piece cover plate for a sump hole.

SUMMARY OF THE INVENTION

An aspect of the present invention is to provide a hood for a submersible sump pump that prevents the float switch and/or debris from tangling with the discharge pipe and pump.

Other aspects of this invention will appear from the following description and appended claims, reference being made to the accompanying drawings forming a part of this specification wherein like reference characters designate corresponding parts in the several views.

The prior art sump pump is removed from the sump. A neck of the hood is placed around the discharge pipe and secured with a tie wrap or hose clamp. The hood extends over the pump. The float tether is secured to the hood with a clamp. The float switch cannot wedge between the pump and the discharge pipe.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
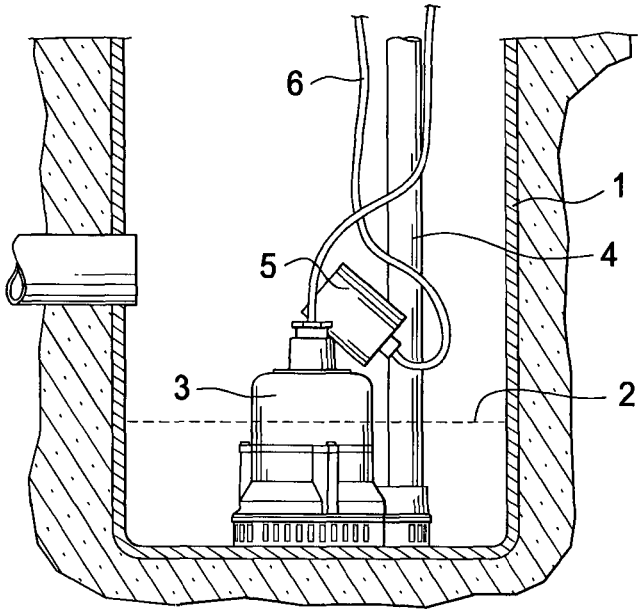
FIG.1 (PRIOR ART)
FIG. 1 is a side elevation view of a float switch wedged between the pump and the discharge pipe.

FIG. 1 shows a sump 1 having a low water level 2. The submersible sump pump 3 feeds a vertical discharge pipe 4. A float switch 5 has a tether 6 which contains electric control wiring, wherein an electric switch inside the float switch 5 closes when the float switch is horizontal as shown in FIG. 1. Thus, in FIG. 1 the sump pump is running with a low water level 2, and it will burn out. The float switch 5 is tangled between the discharge pipe 4 and the sump pump 3.

Figure 2:
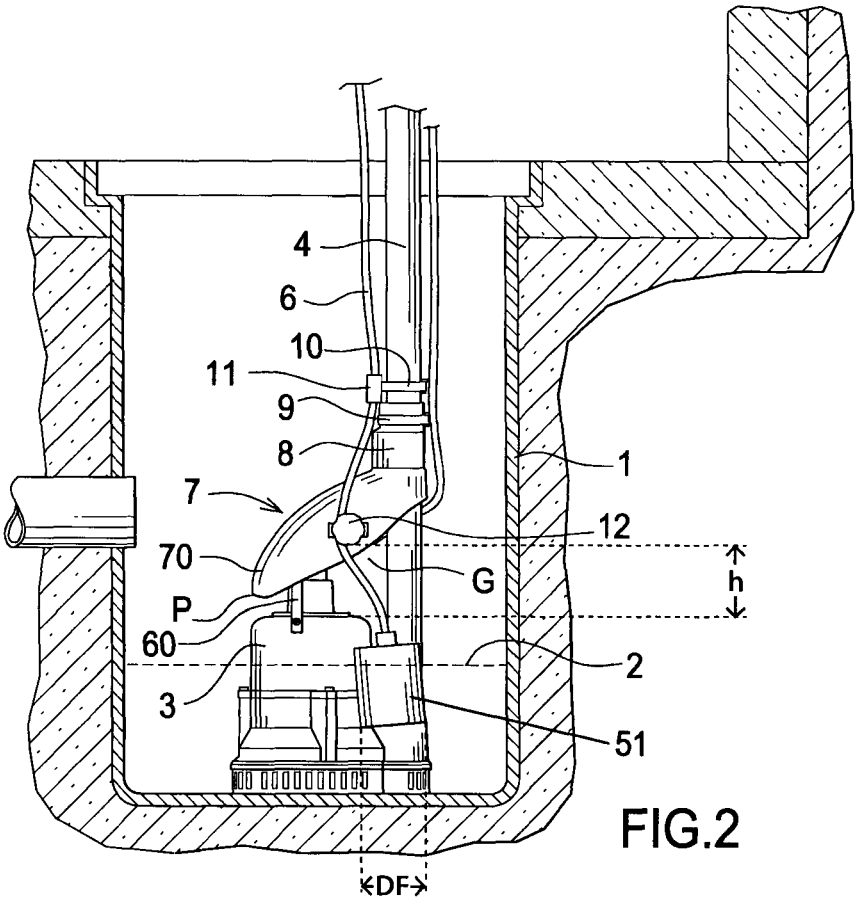
FIG. 2 is a side elevation view of the preferred embodiment mounted on the discharge pipe over a sump pump.

Referring next to FIG. 2 the pump cover 7 is a one piece plastic hood with a neck 8. The hood portion 70 covers the sump pump 3. The distance from the neck 8 to the periphery P is equal to the width of the sump pump so that the hood 70 covers the top of the sump pump as well as straddles the gap G between the discharge pipe 4 and the sump pump 3. The height does not allow the float switch 51 to enter the gap G.

The tether 6 is secured to the discharge pipe 4 with a sheath 11 and wire tie 10. The neck 8 is secured to the discharge pipe 4 with a wire tie 9. The clamp 12 of the hood 70 secures the tether 6 below the wire tie 10. Thus, the float switch 5 rests vertically with the low water level 2 as shown. This vertical orientation keeps the sump pump off. A U bracket 60 is screwed into the sump pump 3 to help secure the cover 7.

Figure 3:
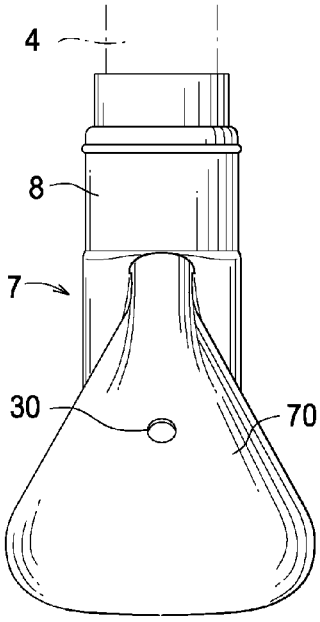
FIG. 3 is a front elevation view of the preferred embodiment alone.
Figure 4:
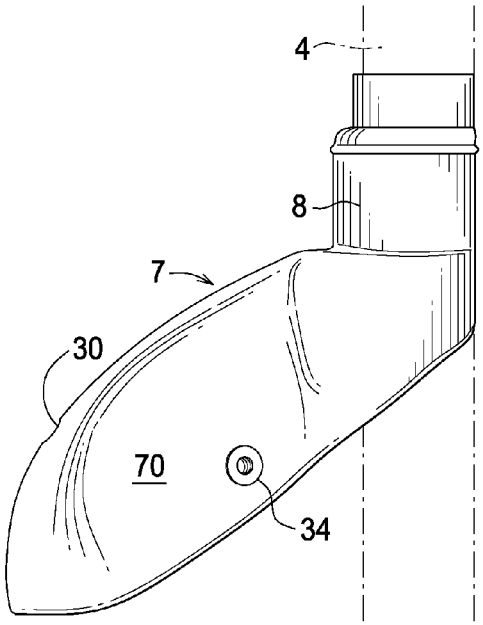
FIG. 4 is a side elevation view of the preferred embodiment alone.
Figure 5:
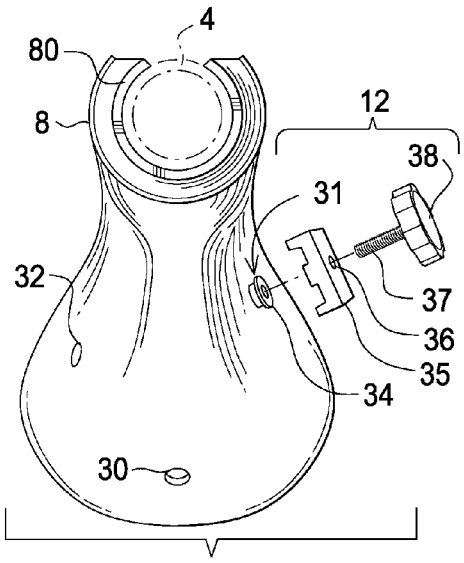
FIG. 5 is a top plan view of the preferred embodiment showing the exploded clamp.

Referring next to FIGS. 3, 4, 5 three clamp mounting holes 30, 31, 32 allow the clamp 12 to be mounted at any hole 30, 31, 32. The mounting hole 31 has a threaded plug 34 inserted into it. The handle 38 has a threaded bolt 37 which passes through hole 36 of anchor 35 and then tightens the anchor 35 against the tether 6 as the bolt 37 is threaded into plug 34. The neck 8 has a cylindrical opening 80 to clasp the discharge pipe 4.

Figure 6:
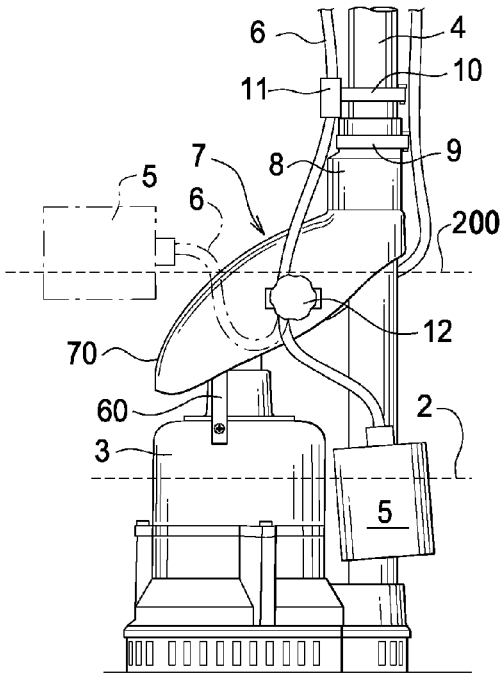
FIG. 6 is a side elevation view of the float switch floating free of the preferred embodiment installed on a sump pump.

In FIG. 6 the dotted float switch 5 is floating horizontally on high water level 200, thus turning on the sump pump 3. The solid lined float switch 5 is at the same position shown in FIG. 2. Float switch 5 has a diameter DF.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. In an apparatus with a sump having a submersible sump pump that feeds a vertical discharge pipe associated next to the submersible sump pump, a gap G, formed between the submersible sump pump and the vertical discharge pipe;

said submersible sump pump having a float switch with a tether containing electric control wiring, wherein the electric switch inside the float switch closes when the float switch is lifted to a horizontal orientation, an improvement comprising:

a sump pump cover having a neck portion sized to conform to the vertical discharge pipe;

a connection attaching the neck portion to the vertical discharge pipe;

said sump pump cover having a hood portion sized to cover the submersible sump pump and straddle gap G;

said hood portion mounted at a height h above said submersible pump;

wherein the sump pump cover prevents an entanglement of the float switch as it rises and falls with a varying water level in the pump; and wherein a U shaped bracket is fastened to the submersible pump to help secure the sump pump cover.

2. The apparatus of claim 1, wherein the tether is fastened to the vertical discharge pipe.

3. The apparatus of claim 1, wherein the sump pump cover further comprises a clamp which secures the tether.

4. The apparatus of claim 2, wherein the sump pump cover further comprises a clamp which secures the tether.

5. The apparatus of claim 1, wherein the hood portion further comprises a cyclindrical opening which clasps the vertical discharge pipe.

6. A float switch entanglement prevention assembly comprising:

a submersible sump pump having a vertical discharge pipe mounted next to it;

a gap G between the submersible sump pump and the vertical discharge pipe;

said submersible sump pump having a float switch connected to the tether;

said tether supporting the float switch hanging next to the submersible sump pump;

a sump pump cover fastened to the vertical discharge pipe;

said sump pump cover having a hood portion covering the submersible sump pump so as to cover the gap G as well;

said hood mounted above the submersible sump pump so as to prevent the float switch from entering the gap G; and wherein the tether is fastened to the vertical discharge pipe above the sump pump cover.

7. The apparatus of claim 6, wherein the sump pump cover has a clamp means functioning to secure the tether.

8. The apparatus of claim 6, wherein the sump pump cover has a clamp means functioning to secure the tether.

9. The apparatus of claim 8, wherein a support bracket between the sump pump cover and the submersible sump pump helps support the sump pump cover.

10. The apparatus of claim 6, wherein the sump pump cover further comprises a neck with a cylindrical opening that attaches to the vertical discharge pipe.

11. A submersible sump pump assembly comprising:

a submersible pump activated by a float switch;

a discharge pipe;

a gap G between the submersible sump pump and the discharge pipe;

a hood secured to the discharge pipe that extends over the submersible pump;

a clamp and a tie securing a float switch wire to the discharge pipe;

a tether on the hood securing the float switch wire to the hood;

the hood secured to the discharge pipe at a height h above the submersible pump such that height h is less than a diameter of the float switch so as to prevent the float switch from entering the gap G.

* * * * *